United States Patent [19]

Ross

[11] Patent Number: 5,018,118

[45] Date of Patent: May 21, 1991

[54] REPLACEABLE WATCH FACE IMPROVEMENT

[76] Inventor: Jeanne Ross, 4618 N. 40th St., Phoenix, Ariz. 85018

[21] Appl. No.: 509,291

[22] Filed: Apr. 16, 1990

[51] Int. Cl.[5] ..... G04B 19/04

[52] U.S. Cl. ..... 368/228; 368/223

[58] Field of Search ..... 368/223–242

[56] References Cited

U.S. PATENT DOCUMENTS

| | | | |
|---|---|---|---|
| 3,111,003 | 11/1963 | Droz | 368/233 |
| 4,444,513 | 4/1984 | Proellochs et al. | 368/223 |
| 4,473,304 | 9/1984 | Kitner | 368/281 |
| 4,525,077 | 6/1985 | Katner | 368/77 |
| 4,660,992 | 4/1987 | Paul et al. | 368/223 |

FOREIGN PATENT DOCUMENTS

| | | | |
|---|---|---|---|
| 0209814 | 6/1960 | Austria | 368/232 |
| 0282934 | 9/1988 | European Pat. Off. | 368/285 |
| 2588975 | 4/1987 | France | 368/232 |
| 2614443 | 1/1988 | France | 368/232 |

*Primary Examiner*—Bernard Roskoski

*Attorney, Agent, or Firm*—Charles E. Cates

[57] ABSTRACT

This invention is a watch including a watch body (12), a watch hand mechansim with a power take-off shaft (14), a removable watch face (16) formed with a minimal aperture (28) through which the shaft means (14) extends, a transparent, removable cover (18) mounted to the watch body (12), watch hands (20, 21) rotatably carried by the cover (18) and connection means (15) adapted to engage the watch hands with the take-off shaft (14) whereby the watch hands (20, 21) and the take-off shaft )14) are connected when the cover (18) is closed and disconnected when the cover (18) is opened.

12 Claims, 2 Drawing Sheets

REPLACEABLE WATCH FACE IMPROVEMENT

BACKGROUND OF THE INVENTION

This invention relates to watches with openable or removable covers to allow for changing the watch face to suit different desires or needs.

U.S. Pat. No. 4,660,992 ("the U.S. Pat. No. '992 "), shows a watch which may be used with a plurality of watch faces. The U.S. Pat. No. '992 teaches that a watch face is received through an opening in the periphery of the watch body. The watch face has a slot from its center to its edge to facilitate placement around the clock hand shaft. A drawback to this watch is that the slot in the watch face is always visible which is both distracting and unattractive. The designs used on the watch face are disrupted by the presence of the slot in the watch face.

Other combination clock display devices are shown in U.S. Pat. Nos. 4,444,513, 4,473,304 and 4,525,077. These patents do not teach a simple, attractive watch with a removable and replaceable face which may be easily manufactured and provides a highly versatile watch with respect to both fashion and information display.

SUMMARY OF THE INVENTION

In accordance with the present invention, a watch body is formed with a rim extending along its periphery and a platform in the face area through which extends the power take-off of a watch hand mechanism, which may be a shaft which rotates and is designed to connect with hands or other time indicia carried by the watch cover. A transparent, openable or removable cover is mounted to the watch body and extends protectively above the face area. The watch hands are rotatably carried by the cover itself in means adapted to be operatively connected to the shaft, whereby the watch hands and the power take-off shaft are coupled when the cover is closed, thus causing the hands to rotate responsive to the watch mechanism, and to disconnect the watch hands and power take-off shaft when the cover is opened.

A watch face means, which is received on the platform in the face area and may be held in place by tabs that are attached to a border on the cover, is formed with a minimal aperture through which the watch hand power take-off from the watch mechanism extends and closely fits. Thus, the initials, logos, decorations, and various combinations thereof can be displayed on the watch face uninterrupted by the aperture.

The watch face may be altered to reflect the wearer's mood or wardrobe, or to give expression to an idea. It may also be used to display art, advertisements or slogans and may be changed at will.

The cover preferably is hinge mounted to the watch body and secured by means of a clasp.

The present invention is highly versatile and may be adapted in a number of different ways to meet the needs of the owner. A digital display may be included in the watch body. The replaceable watch face will in that case have a suitable aperture to accommodate the digital display which may be in lieu of or in addition to an analog display.

The watch mechanism's power take-off means ordinarily is located in the center of the watch face, but it may be put in a segment of the watch face that is off center.

The watch may be a wrist watch, pendant or other jewelry item, or it may be a clock that hangs on the wall.

It is therefore an object of the present invention to provide a watch with an adaptable, easily replaceable watch face which fits tightly so as not to reveal unattractive voids in the watch face.

Another object of the present invention is to provide a watch with a replaceable face having a minimal aperture for connection to the watch mechanisms and which is simple in construction and manufacture.

Still another object of the present invention is to provide a watch with a replaceable face that is highly versatile with respect to both fashion and the display of information.

A further object of the present invention is to provide a watch with a replaceable watch face that readily permits the insertion and removal of the watch face.

BRIEF DESCRIPTION OF THE DRAWINGS

In order that the invention may be understood, a description of the invention is provided herein with reference to the general concepts and an illustrative embodiment thereof, wherein.

DETAILED DESCRIPTION OF THE PREFERRED EMBODIMENT

FIGS. 1-5

Figure 1:
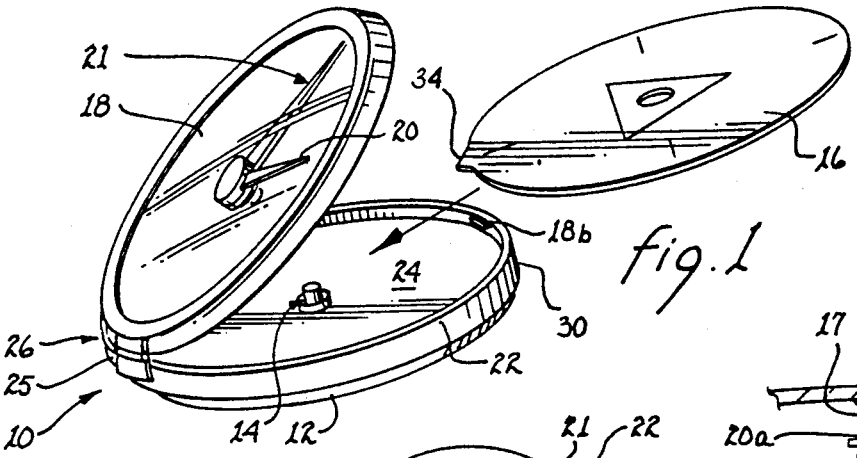
FIG. 1 is a perspective view of the presently preferred embodiment with the watch face removed from its seat.

Referring now to FIGS. 1-5, a watch incorporating a presently preferred embodiment of the invention is identified generally by the reference numeral 10. The watch 10 includes a watch body 12, a power take-off shaft 14, a watch face 16, a transparent, openable cover 18 and watch hands 20, 21. Within the watch body 12, a conventional watch mechanism (not shown) is housed.

The watch body 12 is formed with a generally circular rim 22 along the periphery of the watch. The rim 22 supports a platform 24 which covers the watch mechanism (not shown) and supports a watch face 16. A power take-off shaft 14 extends through the platform 24.

Figure 4A:
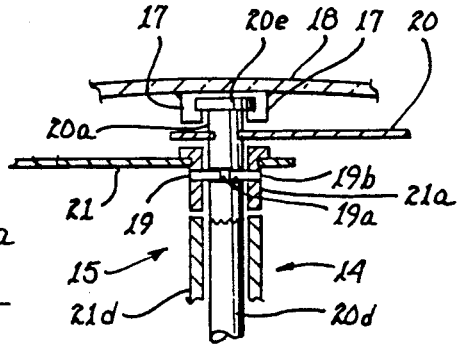
FIG. 4*a* is a cross-section of a fragmentary elevation of FIG. 2 taken along the lines 4*a*—4*a;*
Figure 3:
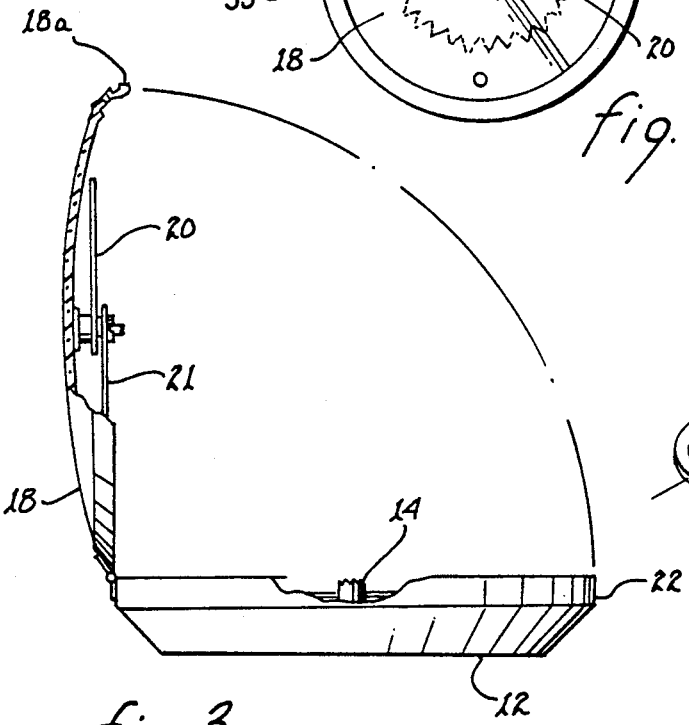
FIG. 3 is an elevation view, partially broken away, illustrating the watch of FIG. 1 with the cover open.
Figure 4B:
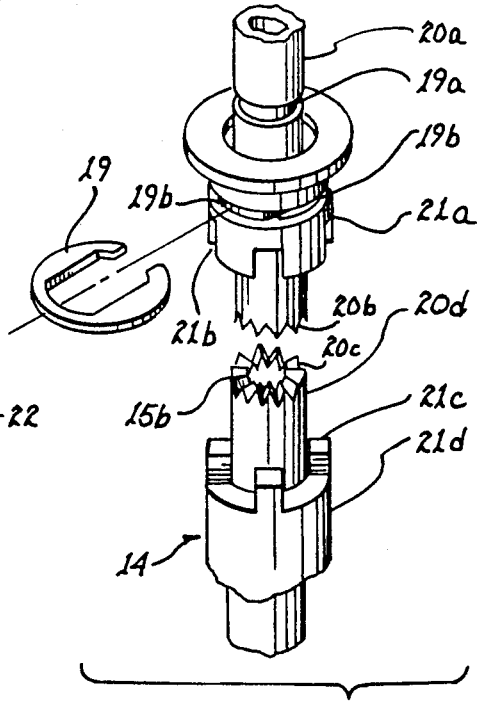
FIG. 4*b* is an enlarged partially broken away and exploded view of the mechanism shown in FIG. 4*a;*

The transparent, removable cover 18 is hinge mounted to the watch body 12 on the rim 22 by a connection means, conveniently a hinge 26 at, for example, the 9 o'clock position 25. The cover 18 carries rotatable watch hands 20, 21 whose extensions 20*a*, 21*a* are adapted to engage the watch mechanism take-off shaft 14. As best seen in FIGS. 4*a* and 4*b*, the watch hands 20, 21 and the take-off shaft components 14 are coupled as at 15 when the cover 18 is closed, thus causing the hands to rotate responsive to the watch mechanism. Latch 18*a* (FIG. 3) and latch retainer 18*b* (FIG. 1) are provided on the cover 18 and rim 22.

The enlarged detail in FIG. 4*b* shows the means for coupling and uncoupling the hands 20, 21 to the power take off shaft 14 are, for the small hand, a small hand extension 20*a* provided with teeth 20*b* which engage teeth 20*c* of the small hand component 20*d* of the the power take-off shaft 14; and for the large hand, an extension 21*a* having crenellations 21*b* which mate with crenellations 21*c* of large hand component 21*d* of power take off shaft 14. The hands 20, 21 and extensions 20*a*, 21*a* are independently rotatable, while attached to and supported by the cover 18. As shown in FIG. 4*a*, the head 20*e* of the small hand extension 20*a* is inserted and rotatably journalled in resiliently deformable fingers 17 and large hand extension 21*a* is rotatably secured to small hand extension 20*a* by means of a snap fit washer 19 that engages groove 19*a* of 20*a* through slots 19*b* of 21*a*. This arrangement makes it possible to raise the cover and disengage the watch hands, leaving the power take off shaft 14 exposed to receive the close fitting watch face 16 by means of the aperture 28.

Figure 5:
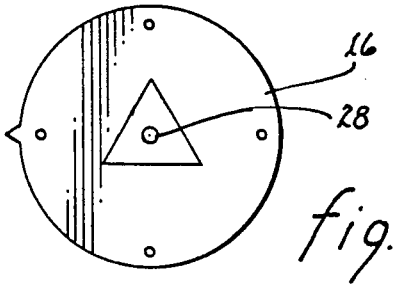
FIG. 5 is a top plan view of the removable watch face of FIG. 1.

As seen in FIG. 5 (also in FIGS. 7*b*, 8*a* and 8*b*) the watch face 16 is formed with a minimal aperture 28 through which the eccentric shaft 14 extends and is thus adapted to be received on the platform 24.

The rim 22 has a border extending along the periphery. On the border 30 one or more indentations, e.g., 33 (see FIG. 2, where 33 is shown in phantom outline at nine o'clock) which may be triangular in shape, are attached, here at nine o'clock, which holds the watch face 16 in place.

Figure 2:
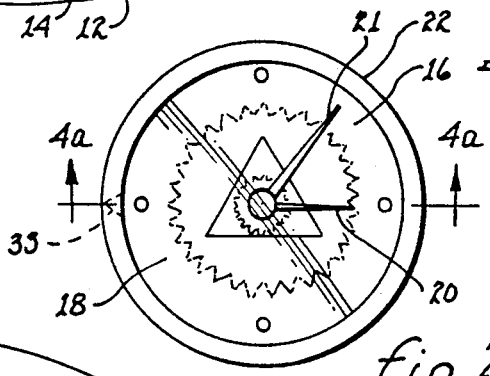
FIG. 2 is a top plan view of the watch of FIG. 1 with the watch face inserted and the cover closed.

As best shown in FIG. 1, the cover 18 can be opened and the watch face 16 can be changed. A top view of the watch 10 with its cover 18 in its closed position is shown in FIG. 2. FIG. 3 shows the watch 10 with its cover 18 in its open position A top view of the watch face 16 is shown in FIG. 5.

FIGS. 6–8

Figure 6:
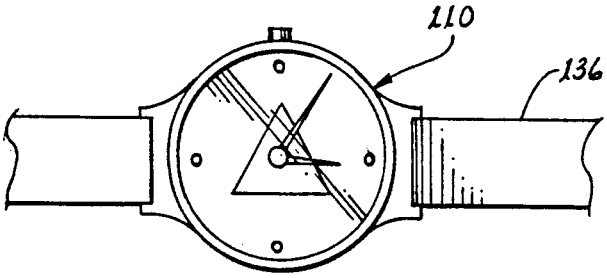
FIG. 6 is a top plan view of another embodiment of the present invention showing an attached watch band.

Another embodiment of the watch is shown in FIG. 6. This embodiment includes a means for attaching a watch band 136 onto the watch 110. The watch band 136 is attached to the watch 110 at two places, a position centered about 6 o'clock and a position about 12 o'clock for example.

Figure 7A:
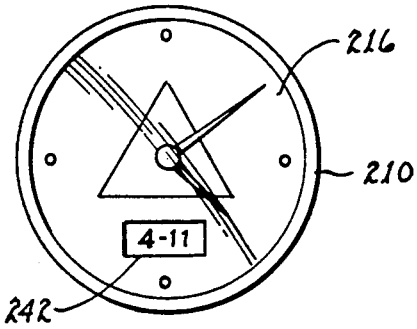
FIGS. 7*a* and 7*b* show a series of top plan views of yet another embodiment of the present invention having a digital display in addition to the analog display, showing sequentially both the watch with the watch face installed, and the watch face in isolation.
Figure 7B:
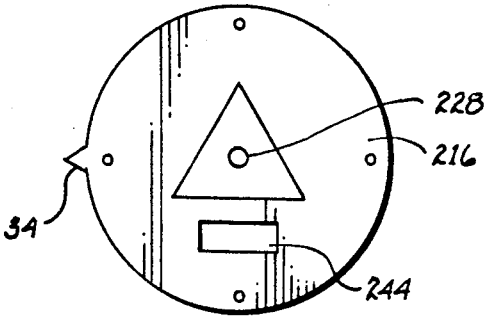

FIGS. 7*a*, 7*b* show a series of views of still another embodiment. In this embodiment, a digital display 242 is provided as part of the watch body. FIG. 7*a* shows a top view of the face 216 in place in the watch 210 with the digital display 242, while FIG. 7*b* shows a top view of the watch face 216 alone. In addition to the minimal aperture 228 in the watch face 216, there is now an aperture 244 through which the digital display 242 is exposed.

Figure 8A:
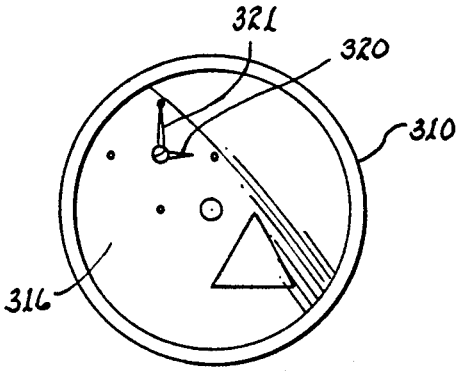
FIGS. 8*a* and 8*b* show a series of top plan views of yet another embodiment showing the hand mechanism and the watch hands located in an off center segment of the watch face, and the watch face in isolation.
Figure 8B:
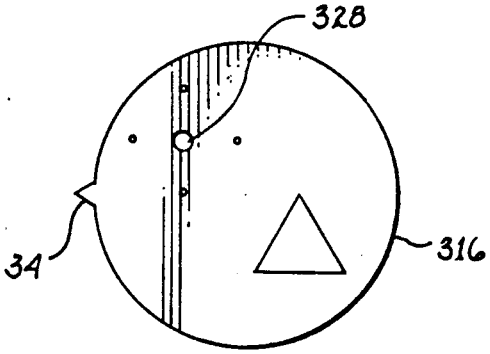
Figure 4C:
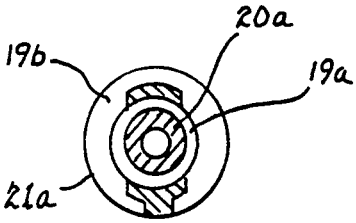
FIG. 4*c* is a cross section of short and long hand extensions viewed end wise at a cut taken at the level of the groove (19*a*) in the small hand extension (20*a*)

Yet another embodiment of the present invention is shown in a series of views in FIGS. 8*a*, 8*b*. The shaft (not shown) and the watch hands 320, 321 are located in a segment of the watch face 316 that is off-center. The top view of the watch 310 with watch hands 320, 321 located in an off-centered segment of the watch face 316 is shown in FIG. 8*a*. A top view of the watch face 316 utilized in that embodiment is shown in FIG. 8*b*. In this embodiment, the minimal aperture 328 is located in an off-center segment of the watch face 316.

The presently preferred embodiments above described are exemplary of various modifications and equivalents within the scope of the invention as distinctly claimed and pointed out in the appended claims.

What is claimed is:

1. A watch body comprising (a) a case;

(b) a watch mechanism carried in said case;

(c) means defining a watch face area on said case;

(d) removable face means adapted to fit said face area, said face means having an aperture therein;

(e) transparent, openable cover means carried by said case by hinge means securing the edge of said cover to said case and adapted to close said case to protect said face means and face area;

(f) analog time indicia means, carried by said cover means;

(g) connection means comprising a power take-off shaft and a time hand extension each having mating end means for engaging axially, adapted to closely fit said aperture, for operatively connecting said time indicia means to said watch mechanism through said aperture in said face means whereby said hand extension axially engages said power take-off shaft when said cover means is closed and said shaft and extension are disconnected when said cover means is opened.

2. The watch body of claim 1 wherein said time indicia means are at least 1 moving hand.

3. The watch body of claim 1 wherein said connection means is a rotatable power take-off shaft form said watch mechanism removably connected to said time indicia means; whereby the connection means is disconnected when said cover means is opened.

4. The watch body of claim 1 wherein said face area comprises a platform having means defining a perimeter of said platform.

5. The watch body of claim 1 wherein said face means is a thin sheet having markings for time.

6. The watch body of claim 5 wherein said face means is a thin sheet having markings for decoration.

7. The watch body of claim 1 wherein said time indicia means are attached to said cover means.

8. The watch body of claim 7 wherein said time indicia means are at least 1 moving hand.

9. The watch body of claim 7 wherein said connection means is a rotatable power take-off shaft from said watch mechanism removably connected to said time indicia means; whereby the connection means is disconnected when said cover means is opened.

10. The watch body of claim 7 wherein said face area comprises a platform having means defining a perimeter of said platform.

11. The watch body of claim 7 wherein said face means is a thin sheet having markings for time.

12. The watch body of claim 7 wherein said face means is a thin sheet having markings for decoration.

* * * * *

UNITED STATES PATENT AND TRADEMARK OFFICE

CERTIFICATE OF CORRECTION

PATENT NO. : 5,018,118

DATED : May 21, 1991

INVENTOR(S) : Jeanne Ross

It is certified that error appears in the above-identified patent and that said Letters Patent is hereby corrected as shown below:

COL. 4, Claim 3, line 42, "form" should be --from--.

Signed and Sealed this

Fifteenth Day of September, 1992

*Attest:*

*Attesting Officer*

DOUGLAS B. COMER

*Acting Commissioner of Patents and Trademarks*